US009624732B2

(12) United States Patent
Beauchamp

(10) Patent No.: US 9,624,732 B2
(45) Date of Patent: Apr. 18, 2017

(54) HOLE OPENER AND METHOD FOR DRILLING

(71) Applicant: First Corp International Inc., Fort Worth, TX (US)

(72) Inventor: Sonny Beauchamp, Dewinton (CA)

(73) Assignee: FIRST CORP INTERNATIONAL INC., Forth Worth, TX (US)

( * ) Notice: Subject to any disclaimer, the term of this patent is extended or adjusted under 35 U.S.C. 154(b) by 267 days.

(21) Appl. No.: 14/333,746

(22) Filed: Jul. 17, 2014

(65) Prior Publication Data

US 2016/0017666 A1 Jan. 21, 2016

(51) Int. Cl.

| | |
|---|---|
| ***E21B 10/43*** | (2006.01) |
| ***E21B 10/55*** | (2006.01) |
| ***E21B 10/60*** | (2006.01) |
| ***E21B 3/00*** | (2006.01) |
| *E21B 10/42* | (2006.01) |
| *E21B 10/54* | (2006.01) |

(52) U.S. Cl.

CPC ..... *E21B 10/55* (2013.01); *E21B 3/00* (2013.01); *E21B 10/43* (2013.01); *E21B 10/602* (2013.01); *E21B 2010/425* (2013.01); *E21B 2010/545* (2013.01)

(58) Field of Classification Search

CPC ..... E21B 10/26; E21B 10/43; E21B 10/55; E21B 10/602; E21B 2010/425; E21B 3/00

See application file for complete search history.

(56) References Cited

U.S. PATENT DOCUMENTS 4,098,363 A * 7/1978 Rohde ..... E21B 10/26 175/391
4,351,401 A * 9/1982 Fielder ..... E21B 10/573 175/428
4,618,010 A * 10/1986 Falgout, Sr. ..... E21B 10/26 175/385
5,887,668 A * 3/1999 Haugen ..... E21B 7/061 175/79

(Continued)

OTHER PUBLICATIONS

Versaream™: Bit Brokers Internataional, Ltd., IL US; http://www.bitbrokers.com/, 2013 (2 pages).

(Continued)

*Primary Examiner* — Daniel P Stephenson
(74) *Attorney, Agent, or Firm* — Hamre, Schumann, Mueller & Larson, P.C.

(57) ABSTRACT

The present document describes a drill-bit which achieves both the rigidity and a fast rate of penetration. The drill-bit comprises a cone shaped central portion comprising a plurality of ribs protruding from the central portion and defining a plurality of blades. The blades are curved along a direction of a longitudinal axis of the cone to facilitate insertion into a hole when rotating in a first direction, and exit from the hole when rotating in a second direction opposite the first direction. The drill-bit comprises a plurality of polycrystalline diamond cutters (PDC) on the blades provided in a first position for cutting the hard structure as the drilling-bit rotates in the first direction, and a plurality of up-drill PDC cutters provided in a second position for cleaning the hole as the drill-bit rotate in the second direction to exit the hole.

20 Claims, 7 Drawing Sheets

(56) References Cited

U.S. PATENT DOCUMENTS 6,412,579 B2 * 7/2002 Fielder ..... E21B 10/26 175/385
6,612,383 B2 * 9/2003 Desai ..... E21B 10/54 175/426
6,672,406 B2 * 1/2004 Beuershausen ..... E21B 10/43 175/430
6,742,607 B2 6/2004 Beaton
7,207,401 B2 * 4/2007 Dewey ..... E21B 29/06 166/55
7,621,351 B2 * 11/2009 Clark ..... E21B 10/26 175/394
8,006,785 B2 * 8/2011 Oldham ..... E21B 7/20 175/171
8,450,637 B2 * 5/2013 Luce ..... B05B 7/222 175/331
8,453,737 B2 * 6/2013 McGlothen ..... E21B 7/061 166/117.5
2005/0145417 A1 * 7/2005 Radford ..... E21B 10/322 175/57
2008/0035388 A1 * 2/2008 Hall ..... E21B 10/602 175/429
2011/0100724 A1 * 5/2011 Azar ..... E21B 10/43 175/428
2014/0360789 A1 * 12/2014 Siracki ..... E21B 10/43 175/336
2016/0017666 A1 * 1/2016 Beauchamp ..... E21B 10/55 175/57

OTHER PUBLICATIONS

PDC Bits, Torquato Drilling Accessories, Oil Drill Bit: Torquato Drilling Accessories, Inc., PA, US: http://www.torquato,com/, Sep. 3, 2014 (4 pages).

Canadian Office Action in corresponding Canadian Application No. 2857637, date Feb. 10, 2016 (4 pages).

* cited by examiner

HOLE OPENER AND METHOD FOR DRILLING

BACKGROUND (a) Field

The subject matter disclosed generally relates to hole openers. In particular, the subject matter relates to drill-bits.

(b) Related Prior Art

Hole openers have long been used in the HDD (Horizontal Directional Drilling) industry as well as in any geological well drilling applications. Traditional hole openers consist of roller cones (built in varying configurations) designed to pound, cut and penetrate rock formations. These "roller-cone" rock bits have been in use since the first design was patented by Baker Hughes in 1909. Since then, the roller cone rock bit has evolved through numerous iterations. The concept, in its most basic of terms, consists of one or more metal toothed, cone shaped, bearing driven cutters that literally roll over the rock continuously while the drilling rig applies pressure or weight from above. As these cone cutters roll over the rock, the metal teeth pound, cut and chew up the rock, allowing the bit to slowly penetrate the formation. An example of a traditional roller-cone rock bit is shown in FIG. 1A.

Another example of a traditional hole opener is shown in FIGS. 1B and 1C. These hole openers are typically referred to as split bits or cone cutter reamers. Generally these hole openers define a rotation shaft around which there is provided two or more drilling cones.

Although such hole-openers/reamers have achieved considerable popularity and commercial success in the HDD application, they frequently experience failures and cause increasing job costs (which are a significant burden to drilling companies). For example, it is a common occurrence for drillers to lose cones from their split bit reamers. This happens for a variety of reasons. Whether it is poor construction of the tool, overuse, or other extenuating circumstances. Cone loss is a constant and looming threat. Having this happen on a bore can be catastrophic. This causes the need for the drilling Company to either fish out the lost cone, and in some cases start the bore again from scratch. All of this is done at the cost of the drilling company.

There is therefore a continuous need for an improved drilling bit which is durable and at the same time achieves a higher drilling speed and less failure.

SUMMARY

The present embodiments provide such drill-bit.

In an aspect, there is provided a drill-bit for drilling holes in a hard structure, the drill-bit comprising: a cone shaped central portion defining an upper end and a lower end; a plurality of ribs protruding from the central portion and defining a plurality of blades, the blades being curved along a direction of a longitudinal axis of the cone to facilitate insertion into a hole when rotating in a first direction, and exit from the hole when rotating in a second direction opposite the first direction; a first set of polycrystalline diamond cutters PDC provided on the blades for cutting the hard structure as the drilling-bit rotates in the first direction.

Each blade may comprise: an upper portion comprising the first set of PDC cutters along an edge thereof for cutting the hard structure as the drilling-bit rotates in the first direction; a middle portion which is substantially parallel to the longitudinal axis for stabilizing the drill-bit when rotating within the hole and for refining an inner surface of the hole; and a lower portion defining a slope starting from the middle portion and ending at the lower end.

In an embodiment, the thickness of the lower portion is substantially null at the lower end of the drill-bit. In an embodiment, one or more sets of back-up PDC cutters may be provided in parallel to or adjacent the first set of PDC cutters on one or more of the blades for improving a rigidity of the blade against the hard structure.

The drill-bit may further comprise one or more up-drill PDC cutters positioned between or adjacent the middle portion of the drill-bit and the lower portion of the drill-bit for cleaning the hole as the drill-bit rotates in the second direction to exit the hole.

In an embodiment, the PDC cutters comprise a top layer of polycrystalline diamond integrally sintered onto a tungsten carbide substrate.

In an embodiment, the drill-bit may be hollow on at least one of the lower end and upper end and defines an inner thread for connecting to a pipe of a drilling-rig.

The drill-bit may further comprise a plurality of nozzles fluidly connected to the pipe for cleaning the blades and the PDC cutters. The nozzles may be provided in a plurality between adjacent blades, the nozzles being positioned to clean at least the upper portion and the middle portion of the drill-bit. In an embodiment, a set of nozzles may be provided adjacent each edge of each blade to have two sets of nozzles between adjacent blades.

In another aspect, there is provided a method for making a hole in a hard structure comprising: connecting the described drill-bit to the pipe of a drilling-bit; applying pressure on the drill-bit; rotating the drill-bit in a first direction to penetrate the hard structure.

In an embodiment, the method may further comprise rotating the drill-bit in a second direction opposite the first direction to exit the hole.

In a further aspect, there is provided, a drill-bit for drilling holes in a hard structure, the drill-bit comprising: a cone shaped central portion defining an upper end and a lower end; a plurality of ribs protruding from the central portion and defining a plurality of blades, the blades being curved along a direction of a longitudinal axis of the cone to facilitate insertion into a hole when rotating in a first direction, and exit from the hole when rotating in a second direction opposite the first direction; and a first set of pockets provided on the blades for receiving a first set of polycrystalline diamond cutters (PDC), the pockets of the first set being positioned to allow the PDC cutters received therein to cut the hard structure as the drilling-bit rotates in the first direction to open the hole.

Each blade may comprise an upper portion comprising the first set of pockets along an edge thereof; a middle portion which is substantially parallel to the longitudinal axis for stabilizing the drill-bit when rotating within the hole and for refining an inner surface of the hole; and a lower portion defining a slope starting from the middle portion and ending at the lower end of the drill-bit.

In an embodiment, the thickness of the lower portion is substantially null at the lower end of the drill-bit.

In a further embodiment, the drill-bit may further comprise one or more up-drill PDC cutters positioned between or adjacent the middle portion and the lower portion of the drill-bit for cleaning the hole as the drill-bit rotates in the second direction to exit the hole.

The drill-bit may be hollow on at least one of the lower end and upper end and defines an inner thread for connecting to a pipe of a drilling-rig.

In an embodiment the drill-bit further comprises a plurality of nozzles fluidly connected to the pipe for cleaning the blades and the PDC cutters. The nozzles may be provided in a plurality between adjacent blades, the nozzles being positioned to clean at least the upper portion and the middle portion of the drill-bit.

In an embodiment, a set of nozzles is provided adjacent each edge of each blade to have two sets of nozzles between adjacent blades.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

The embodiments describe a drill-bit for making holes in a hard structure such as a rock. The drill-bit has no moving parts and achieves both the rigidity and the fast rate of penetration into the rocks. In an embodiment, the drill-bit comprises a cone shaped central portion comprising a plurality of ribs protruding from the central portion and defining a plurality of blades. The blades are curved along a direction of a longitudinal axis of the cone to facilitate insertion into a hole when rotating in a first direction, and exit from the hole when rotating in a second direction opposite the first direction. Each blade comprises a plurality of polycrystalline diamond cutters (PDC) provided in a first position for cutting the hard structure as the drilling-bit rotates in the first direction, and a plurality of updrill PDC cutters provided in a second position for cleaning the hole as the drill-bit rotates in the second direction to exit the hole.

Figure 1C:
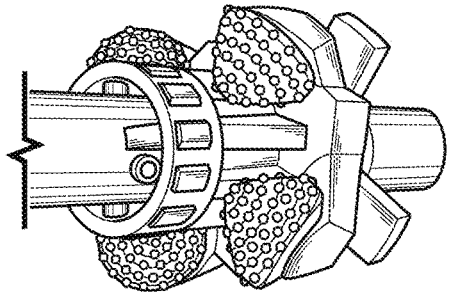
PRIOR ART FIG. 1C
FIGS. 1A to 1C illustrate examples of traditional drill bits.
Figure 1B:
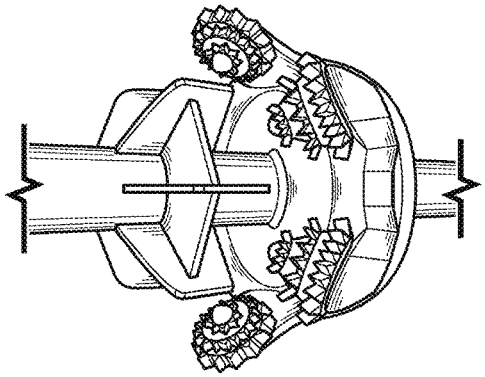
PRIOR ART FIG. 1B
Figure 1A:
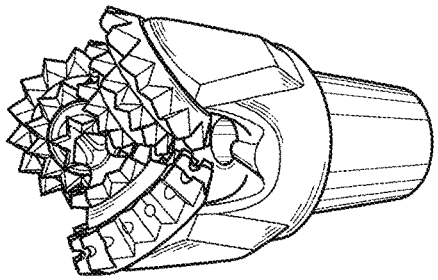
PRIOR ART FIG. 1A
Figure 2A:
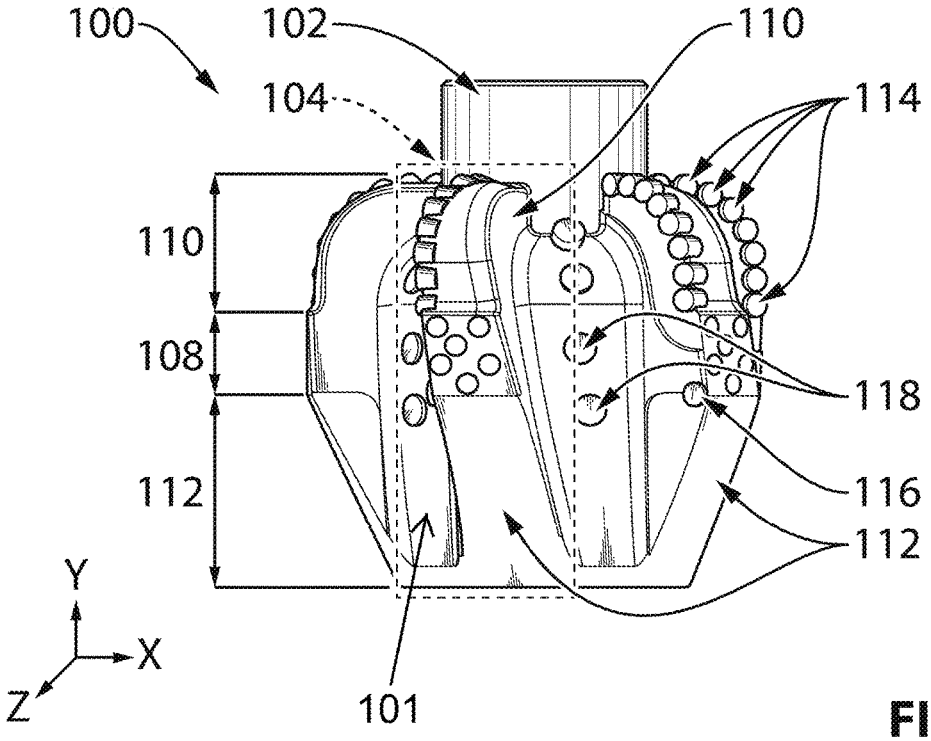
FIG. 2A is a side view of a drill-bit in accordance with an embodiment.
Figure 2B:
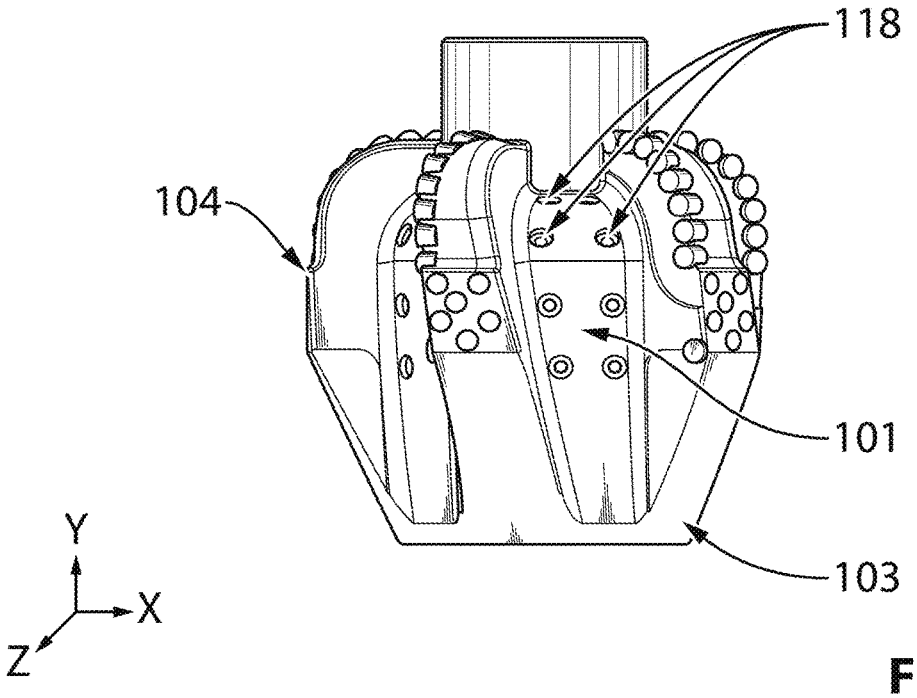
FIG. 2B is side view image of an exemplary drill-bit.
Figure 3A:
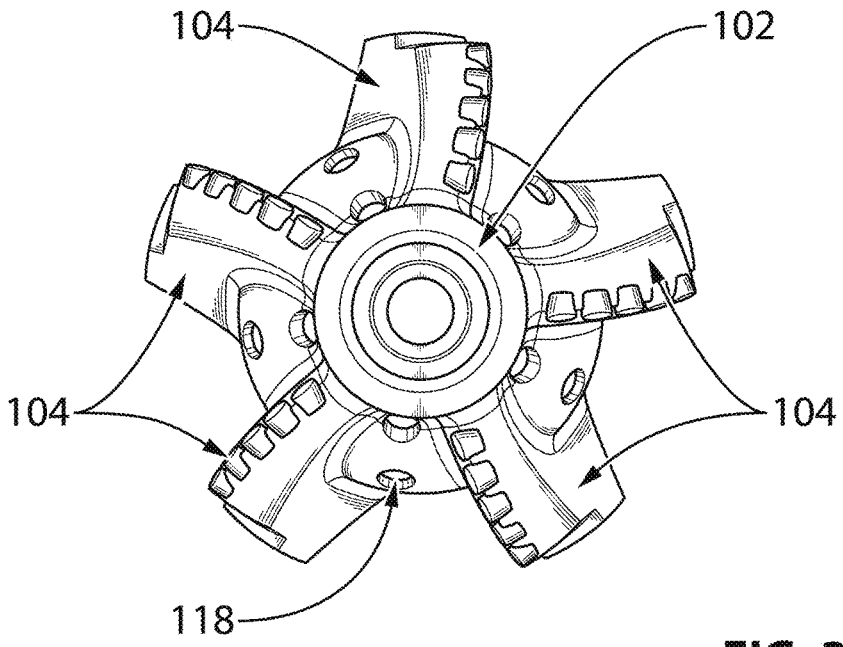
FIG. 3A is a top view of the drill-bit of FIG. 2A showing the upper connection.
Figure 3B:
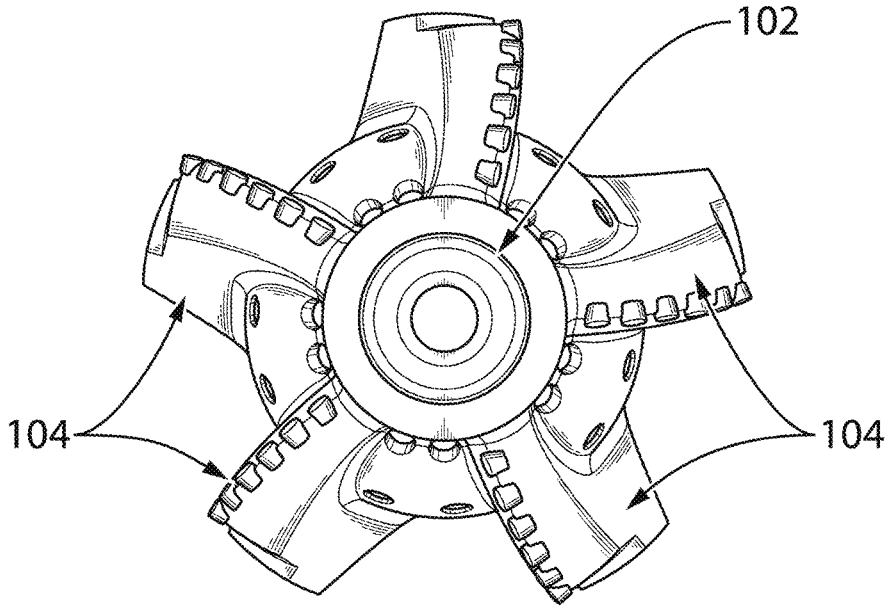
FIG. 3B is a top view image of an exemplary drill-bit in accordance with an embodiment.

FIG. 2A is a side view of a drill-bit in accordance with an embodiment, and FIG. 2B is side view image of an exemplary drill-bit. Likewise, FIG. 3A is a top view of the drill-bit of FIG. 2A showing the upper connection, and FIG. 3B is a top view image of an exemplary drill-bit in accordance with an embodiment.

Figure 3C:
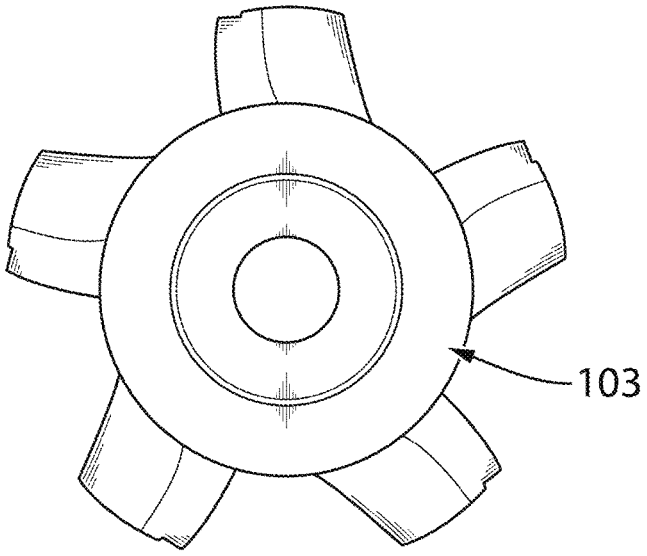
FIG. 3C is a side view of the bottom connection of the drill-bit opposite to the upper connection.
Figure 3D:
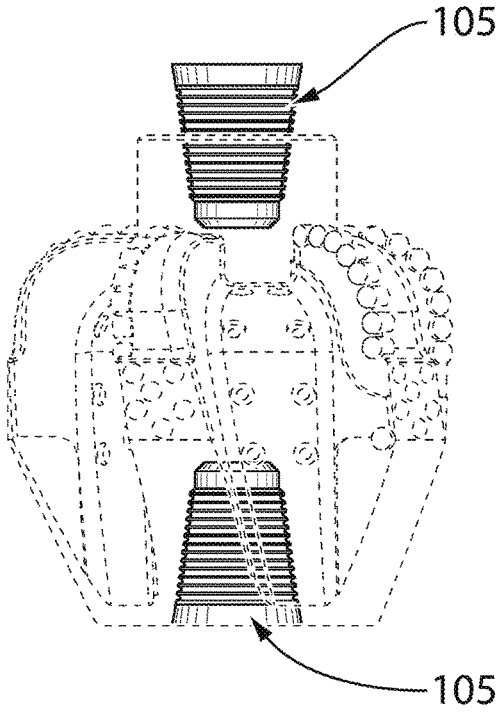
FIG. 3D is a three dimensional view of the drill-bit of FIG. 2A showing the inner threads.

As shown in FIGS. 2A and 2B, the drill-bit 100 comprises a central portion defining a cone 101 and top and bottom connections 102 and 103 with inner threads 105 (as shown in FIG. 3D) for connecting to a drilling rig. Depending on whether the driller is push-reaming or pull-reaming, this connection may face toward the drill rig or away from it, whereby a pull reamer will face the drilling rig, and a push reamer will point away from the rig. In other words the pipe may be connected to either the top connection 102 or to the bottom connection 103. FIG. 3C is a side view of the bottom connection 103 of the drill-bit opposite to the upper connection 102, and FIG. 3D is a three dimensional view of the drill-bit of FIG. 2A showing the inner threads 105.

Referring back to FIGS. 2A and 2B, it is shown that the drill-bit comprises a plurality of blades/ribs 104 (3-9 blades or and preferably 5-6 blades for a regular hole) provided co-centrally around the connection 102 and protruding from the cone 101. In an embodiment, the blades are shaped and dimensioned to open the hole and advance into the latter when the rotation is in a first direction and to exit from the hole and clean the latter when the rotation is in a second direction opposite the first direction. In the embodiment exemplified in FIG. 2A, the blades are slightly curved along the direction of the rotation axis 108 (y axis) so as to ensure a smooth penetration into the rock to open the hole when the rotation is clockwise and a smooth/easy exit from the hole when the rotation is counter-clockwise. Accordingly, the blades are shaped and dimensioned to facilitate penetration into the hole and exit from the hole as a result of the rotation of the drill-bit in the appropriate direction.

The blades may define a middle portion 108, an upper portion 110 adjacent the connection 102 and a lower portion 112 defining a ski slope and provided at the lower half of the cone 101 as shown in FIGS. 2A and 2B. In an embodiment, the ski slopes 112 end at the bottom 103 of the drill-bit 100 and do not extend past the latter as clearly shown in FIGS. 2A and 2B.

In an embodiment, the blades 102 may also be curved along the Z axis and have different thicknesses along the Y axis and different widths along the X axis. In an embodiment, the width of the blades may increase as the thickness decreases and vice versa to maintain the rigidity of the blades beyond a certain level.

Figure 4:
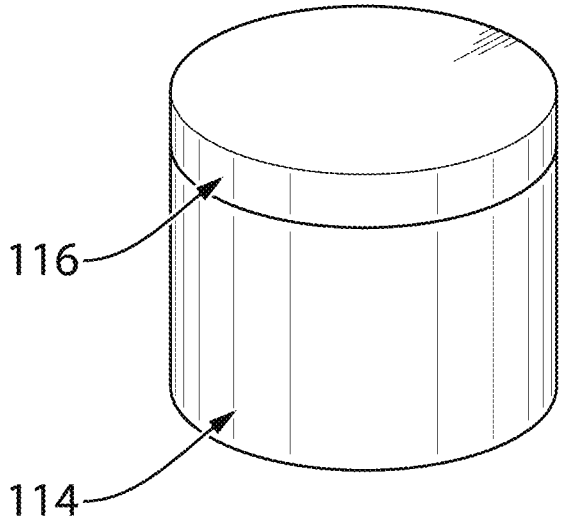
FIG. 4 illustrates an example of a PDC cutter in accordance with an embodiment.

In an embodiment, the upper portion 110 of the blades 104 may include a plurality of Polycrystalline Diamond Cutters (aka PDC cutters) 114 for cutting the rock as the drill-bit 100 rotates to make the hole. The PDC cutters may be provided in a row at the edge of blade which is the main point of contact between the drill-bit and the rock formation. The blades may be dimensioned to have holes/pockets therein to receive the PDC cutters. The number of PDC cutters is determined based on the hardness of the rock that is being cut. FIG. 4 illustrates an example of a PDC cutter in accordance with an embodiment. As shown in FIG. 4, the PDC cutter 114 comprises a polycrystalline diamond (PCD) top layer 120 integrally sintered onto a tungsten carbide substrate using a high-pressure, high-temperature process. This layer combination allows consistent high drilling performance to be maintained. The polycrystalline diamond layer offers controlled wear and the retention of a sharp cutting edge. The tungsten carbide substrate provides a strong and tough support for the polycrystalline diamond layer while facilitating attachment to the drill-bit body.

The middle portion 108 (aka gage pad 108) of the blade may be substantially parallel to the Y axis for stabilizing the drill-bit while in the hole and also for defining and refining the inner surface of the hole. The different gage pads 108 of the different blades are concentrically provided around the rotation axis of the drill-bit to avoid deviation of the drill-bit to the left or the right or up or down while rotating within the hole.

The lower portion (aka ski-slope) 112 of the blade is designed for easier pushing or pulling of the bit forward or backward while swabbing the hole. Swabbing is necessary to make sure the bore is clean and free of rock debris left behind during the cutting process. The shape of the lower portion 112 helps the bit 100 not to get hung up on any debris left behind in the bore.

One or more up-drill PDC cutter 116 may be positioned for reverse drilling only to allow the drill to drill its way of the hole. In the example of FIG. 2A, the up-drill cutter 116 is provided between the gage pad 108 and the lower portion 112. The up-drill PDC cutters 116 serve to clean the hole as the drill-bit rotates in the opposite direction of the drilling rotation e.g. clockwise, to exit the hole because the reverse rotation makes the location of the up-drill cutter 116 as the main surface with the debris in the hole. The up-drill PDC cutters 116 are designed to assist in the swabbing of the hole. If there is any residual rock formation, the up drills will cut the rock as the bit is pushed or pulled in the swabbing process.

Referring back to FIGS. 2A and 2B, there is shown a plurality of nozzles 118 provided between adjacent blades. Accordingly, the cone 101 may be hollow at the center thereof to fluidly connect the drilling pipe connected to the top connection 102 or the bottom connection 103 for providing the nozzles with a stream of water from outside the hole. A plug may be provided at the bottom portion 103 or top portion 102 of the drill-bit 100 (depending on which end of the drill-bit the pipe is connected to) for preventing the water/fluid from running there through, thereby forcing the water flowing through the pipe to exit from the nozzles 118.

Figure 5:
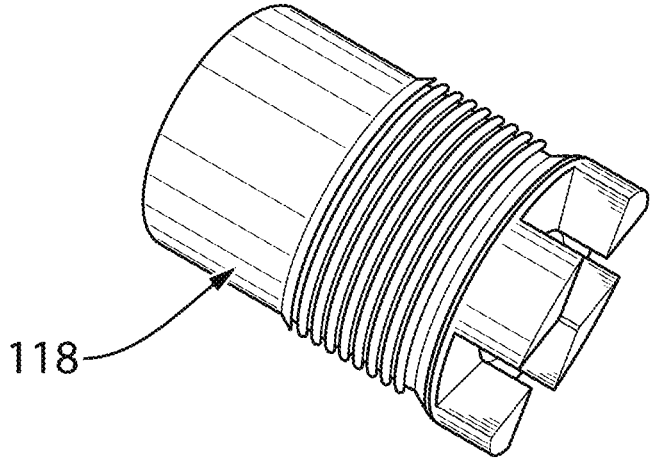
FIG. 5 illustrates an example of a nozzle in accordance with an embodiment.

FIG. 5 illustrates an example of a nozzle in accordance with an embodiment. The nozzles 118 are located between the blades and positioned to clean the PDC cutters and/or the blades using a water stream injected under pressure through the pipe and out of the nozzles 118. For instance as shown in FIGS. 2A and 2B, the nozzles may be provided in proximity of at least the upper portion 110 and the gage pad 108 since these portions have a higher thicknesses when compared to the lower portion 112 and therefore, debris is more likely to accumulate at these portions rather than the lower portion 112.

In operation, as the drill-bit 100 rotates, the rig applies the appropriate amount of push pressure to the bit 100. The PDC cutters scrape the formation, and the drilling fluid then carries the cuttings through the bore hole back to the surface, and into a pit. There the cuttings are collected, run through a shaker, and the drilling fluid is pumped back through the drilling rig and back through the drilling rods and back through the bit. This recirculation continues throughout the remainder of the bore.

Accordingly, the embodiments describe a drilling bit which has no moving parts, and thus, it is less prone to failure and breaking in the hole. Testing has shown that the present drill-bit can achieve a higher rate of penetration (ROP) of at least 40%-60% higher than existing bits due to the shape and structure of its blades. In some cases the increase in ROP was 5-7 times. A comparison was done in Hamilton, Tex. where a driller was penetrating the rock at 3-4 inches per minute with their cone cutter reamer. When they tested the drill-bit of the present invention (known as the DDI Volcano PDC Hole Opener/Reamer), their ROP increased to 3½ feet per minute. With respect to rigidity and failure rate, testing has shown that the present drill-bit has reduced the failure rate by 85%.

The higher rate of penetration is due to the fact that traditional "split bit" or cone cutter reamers pound and cut the formation using moving parts, while the present drill-bit scrapes and cuts the formation as the entire bit rotates within the hole. The higher rate of penetration translates to savings in fuel and labor for the drilling companies and faster deliveries for the clients.

Another problem associated with the traditional hole openers is that each cone cutter is designed to cut different types of rock, and this becomes a problem when the bit transitions from one layer of rock formation to another i.e. from limestone to shale to clay to dirt. Since there does not exist a single cone cutter that is designed to cut rock formations of varying hardness, the driller is forced to choose the cutter type for the rock he thinks he'll be in more than the others. This is a very difficult guessing game, because it is rare to have accurate geological data. In fact, it is more common to have incorrect data than to have correct data, if any at all. The ideal scenario for any driller is to have a bit that is capable of cutting all ground formations with equal effectiveness.

To address this problem, the drill-bit 100 may be coated with a layer of Tungsten Carbide to allow the drill-bit 100 to drill in formations with different hardness and without breaking and/or wearing quickly. In an embodiment, the thickness of the Tungsten Carbide may vary depending on the area on which it is being applied. For example, areas of the blade which are in higher contact with the debris during forward and backward drilling may have a thicker layer to improve their rigidity.

Figure 6A:
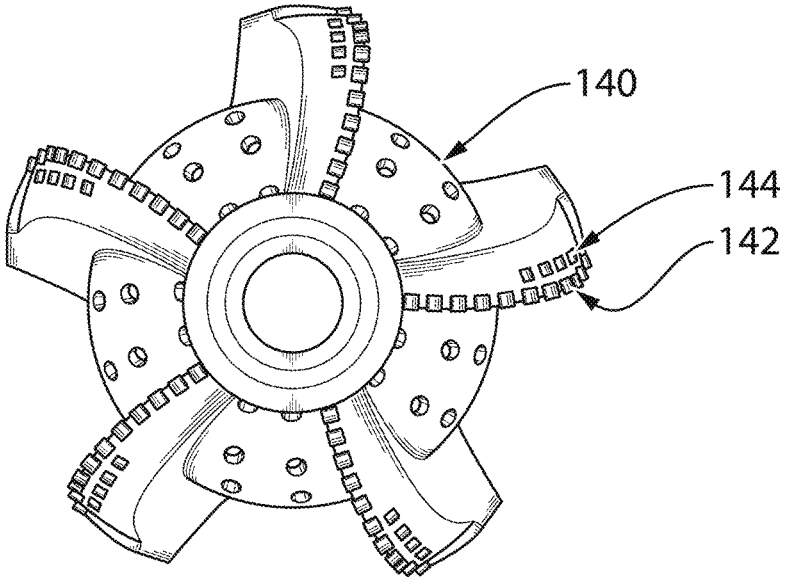
FIGS. 6A and 6B illustrate different views of a drill-bit including two rows of PDC cutters in accordance with an embodiment.
Figure 6B:
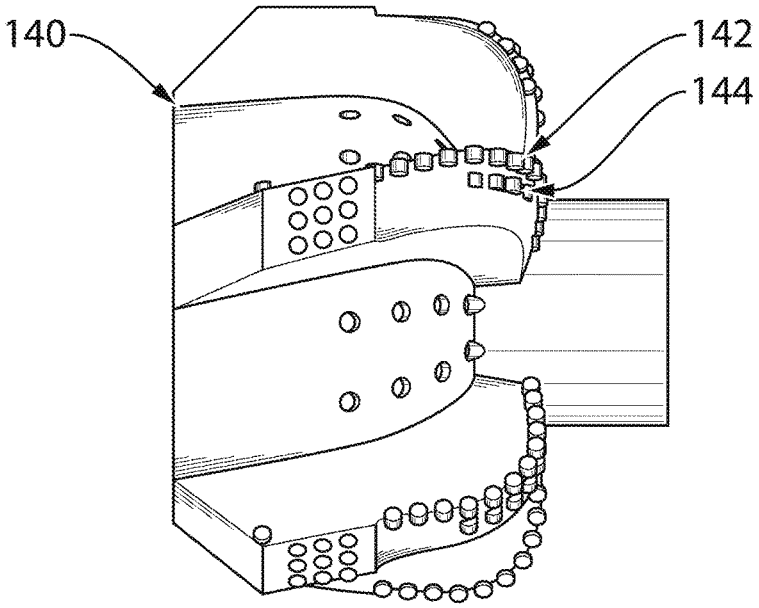
Figure 6C:
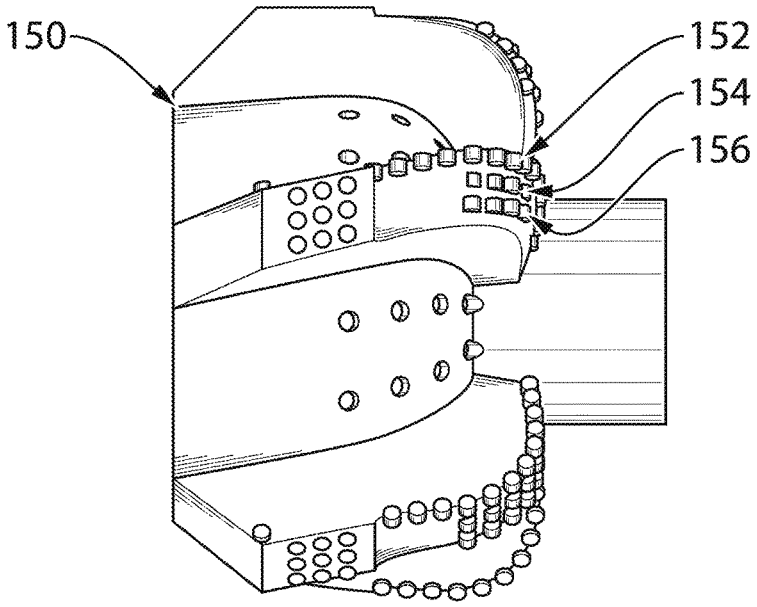
FIGS. 6C and 6D illustrate different views of a drill-bit including three rows of PDC cutters in accordance with another embodiment.
Figure 6D:
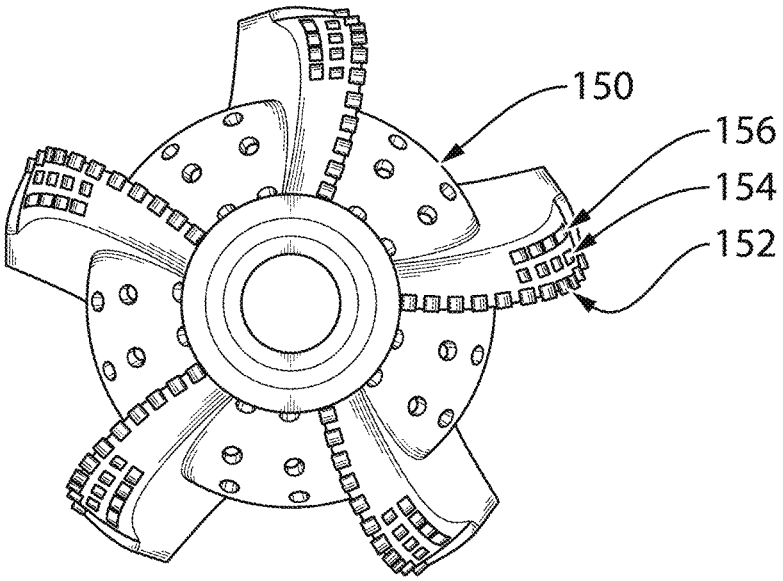

In an embodiment, to improve the rigidity of the drill-bit and decrease interruptions during the drilling process, one or more additional rows (or partial rows) of PDC cutters may be provided in the drill-bit parallel to or adjacent the main row of PDC cutters shown in FIGS. 2A and 2B. The additional rows may be provided in areas that sustain the most pressure and friction with the rock formation. In an embodiment, the additional rows of PDC cutters may be provided on the upper section of the blade adjacent the gage pad as exemplified in FIGS. 6A to 6D. FIGS. 6A and 6B illustrate different views of a drill-bit including two rows of PDC cutters in accordance with an embodiment, and FIGS. 6C and 6D illustrate different views of a drill-bit including three rows of PDC cutters in accordance with another embodiment.

As shown in FIGS. 6A and 6B, the drill-bit 140 comprises a plurality of blades. One or more of these blades comprise primary row of PDC cutters 142 provided at the edge of the blade, and a secondary row 144 of back-up PDC cutters provided parallel to and adjacent the primary row 142. The blade may include a first row of pockets for receiving the first row 142 of PDC cutters and a secondary row of pockets provided behind the first row of pockets. Similarly, FIGS. 6C and 6D illustrate a similar drill-bit 150 with three rows of PDC cutters: a main row 152, a second row 154 and a third row 154. Needless to say, four or more rows of PDC cutters may be included all depending on the thickness of the blade at the portion of the blade where the additional rows of PDC cutters are added.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A drill-bit for drilling a hole in a hard structure, the drill-bit comprising:

a central portion having a first end, a second end, and a longitudinal axis;

a plurality of blades protruding substantially radially from the central portion, each blade having:

a first blade end, a second blade end, a first end portion, a second end portion and a middle portion;

the first blade end is positioned closer to the first end than to the second end, and the second blade end is positioned closer to the second end than to the first end;

the first end portion includes the first blade end and extends from the first blade end to the middle portion, and the first end portion includes an outer facing surface that extends from the first blade end to the middle portion, and at least a portion of the outer facing surface extends radially from the central portion perpendicular to the longitudinal axis;

the middle portion is disposed between and connected to the first end portion and to the second end portion, the middle portion includes an outer facing surface that is parallel to the longitudinal axis, the outer facing surface of the middle portion forms a radially outermost diameter of the drill-bit;

the second end portion includes the second blade end and extends from the middle portion toward the second end;

a plurality of polycrystalline diamond cutters disposed on the outer facing surface of the first end portion, the plurality of polycrystalline diamond cutters extend the entire length of the outer facing surface of the first end portion from the first blade end to the middle portion.

2. The drill-bit of claim 1, wherein the second blade end of each blade terminates at the second end of the central portion so that the second blade end of each blade and the second end of the central portion coincide.

3. The drill-bit of claim 1, further comprising one or more sets of back-up polycrystalline diamond cutters provided in parallel to or adjacent the polycrystalline diamond cutters on one or more of the blades for improving a rigidity of the blades against the hard structure.

4. The drill-bit of claim 1, further comprising, for each of the blades, one or more up-drill polycrystalline diamond cutters positioned between or adjacent the middle portion and the second end portion.

5. The drill-bit of claim 1, wherein the central portion is hollow from the first end to the second end, and the first end and the second end each define an inner thread.

6. The drill-bit of claim 1, further comprising a plurality of nozzles mounted on the central portion.

7. The drill-bit of claim 6, wherein the nozzles are provided in a plurality between adjacent blades, the nozzles being positioned to clean at least the first end portion and the middle portion of the adjacent blades.

8. The drill-bit of claim 1, further comprising two sets of nozzles between each of the adjacent blades.

9. A method for making a hole in a hard structure comprising:

connecting the drill-bit of claim 1 to a pipe of a drilling-rig;

applying pressure on the drill-bit;

rotating the drill-bit in a first direction to penetrate the hard structure and create the hole.

10. The method of claim 9, further comprising rotating the drill-bit in a second direction opposite the first direction to exit the hole.

11. A drill-bit for drilling a hole in a hard structure, the drill-bit comprising:

a central portion having a first end, a second end, and a longitudinal axis;

a plurality of blades protruding substantially radially from the central portion, each blade having:

a first blade end, a second blade end, a first end portion, a second end portion and a middle portion;

the first blade end is positioned closer to the first end than to the second end, and the second blade end is positioned closer to the second end than to the first end;

the first end portion includes the first blade end and extends from the first blade end to the middle portion, and the first end portion includes an outer facing surface that extends from the first blade end to the middle portion, and at least a portion of the outer facing surface extends radially from the central portion perpendicular to the longitudinal axis;

the middle portion is disposed between and connected to the first end portion and to the second end portion, the middle portion includes an outer facing surface that is parallel to the longitudinal axis, the outer facing surface of the middle portion forms a radially outermost diameter of the drill-bit;

the second end portion includes the second blade end and extends from the middle portion toward the second end;

a plurality of pockets provided on the outer facing surface of the first end portion for receiving polycrystalline diamond cutters, the pockets being positioned to allow polycrystalline diamond cutters received therein to cut the hard structure, and the pockets extend the entire length of the outer facing surface of the first end portion from the first blade end to the middle portion.

12. The drill-bit of claim 11, wherein the second blade end of each blade terminates at the second end of the central portion so that the second blade end of each blade and the second end of the central portion coincide.

13. The drill-bit of claim 11 further comprising one or more sets of back-up pockets provided in parallel to or adjacent the pockets on one or more of the blades, the back-up pockets are configured to receive additional polycrystalline diamond cutters.

14. The drill-bit of claim 11, further comprising, for each of the blades, one or more up-drill polycrystalline diamond cutters positioned between or adjacent the middle portion and the second end portion.

15. The drill-bit of claim 11, wherein the central portion is hollow from the first end to the second end, and the first end and the second end each define an inner thread.

16. The drill-bit of claim 11, further comprising a plurality of nozzles mounted on the central portion.

17. The drill-bit of claim 16, wherein the nozzles are provided in a plurality between adjacent blades, the nozzles being positioned to clean at least the first end portion and the middle portion of the adjacent blades.

18. The drill-bit of claim 11, further comprising two sets of nozzles between each of the adjacent blades.

19. A drill-bit for drilling a hole, the drill-bit comprising:

a central portion having a first end, a second end, and a longitudinal axis;

a plurality of blades protruding substantially radially from the central portion, each blade having:

a first blade end, a second blade end, a first end portion, a second end portion and a middle portion;

the first blade end is positioned closer to the first end than to the second end, and the second blade end is positioned closer to the second end than to the first end;

the first end portion includes the first blade end and extends from the first blade end to the middle portion, and the first end portion includes an outer facing surface that extends from the first blade end to the middle portion, and at least a portion of the outer facing surface extends radially from the central portion perpendicular to the longitudinal axis;

the middle portion is disposed between and connected to the first end portion and to the second end portion, the middle portion includes an outer facing surface that is parallel to the longitudinal axis, the outer facing surface of the middle portion forms a radially outermost diameter of the drill-bit;

the second end portion includes the second blade end and extends from the middle portion toward the second end;

a plurality of polycrystalline diamond cutters disposed on the radially extending portion of the outer facing surface.

20. The drill-bit of claim 19, further comprising a plurality of additional polycrystalline diamond cutters on the outer facing surface of the first end portion from the radially extending portion to the middle portion.

* * * * *